US005639174A

United States Patent [19]

Gonska

[11] Patent Number: 5,639,174

[45] Date of Patent: Jun. 17, 1997

[54] DOUBLE HINGED MODULAR CARGO UNIT

[75] Inventor: David G. Gonska, Warren, Mich.

[73] Assignee: The United States of America as represented by the Secretary of the Army, Washington, D.C.

[21] Appl. No.: 636,993

[22] Filed: Apr. 15, 1996

[51] Int. Cl.[6] ..... B65D 19/12; B65D 19/38

[52] U.S. Cl. ..... 403/103; 403/101; 108/55.1; 16/327; 16/331

[58] Field of Search ..... 224/42, 34; 414/537, 414/538; 108/55.1, 54.1; 16/324, 331, 327; 403/83, 91, 101, 103

[56] References Cited

U.S. PATENT DOCUMENTS

| | | | |
|---|---|---|---|
| 1,612,859 | 1/1927 | Dyett | 224/42.34 |
| 2,579,655 | 12/1951 | Donald | 108/55.1 X |
| 3,499,398 | 3/1970 | Murray | 108/55.1 X |
| 3,620,388 | 11/1971 | Mansson | 108/55.1 X |
| 4,127,201 | 11/1978 | Baumann | 414/538 X |
| 4,319,732 | 3/1982 | Godfrey | 108/55.1 X |
| 4,353,520 | 10/1982 | Jansson | 108/55.1 X |

*Primary Examiner*—Anthony Knight
*Attorney, Agent, or Firm*—Peter A. Taucher; David L. Kuhn

[57] ABSTRACT

A collapsible, stackable cargo unit for carrying one or more vehicles has a swingable ramp by which vehicles roll on or off the unit. The ramp swings to a fixed upright position during vehicle shipment. After the vehicles are unloaded, the ramp swings down and inwardly relative to the unit so that the ramp lies flat upon a lower frame of the unit. The connection between the ramp and the lower frame includes a terminus fixed to the lower frame. The terminus has opposed upright walls defining slots, the slots having major diameters normal to the lower frame. The connection also has a floating block whose pins rotatably and slidably fit in the slots of the terminus. The connection also has an ear fixed to a post forming one side of the ramp. The ear has a slot aligned with the longitudinal axis of the post. The ear faces on the floating block, and a stud on the floating block fits in this slot. The stud and slot let the post rotate and slide on the floating block.

10 Claims, 4 Drawing Sheets

DOUBLE HINGED MODULAR CARGO UNIT

GOVERNMENT USE

The invention described here may be made, used and licensed by or for the U.S. Government for governmental purposes without paying me royalty.

BACKGROUND AND SUMMARY

One of the logistic problems for U.S. military ground forces is the global transport of large numbers of automotive military support vehicles to a given theater of operations. As to this problem, it is known to transport vehicles in cargo units that can be stacked when full. Such cargo units may conventionally be collapsible from their larger, cargo carrying configuration to a smaller, non cargo carrying configuration. Collapsing the cargo units is typically done by folding their end walls inward relative to the unit so that the unit becomes flatter and more compact. After being collapsed, the cargo units can be stacked and shipped alone. Such collapsible, stackable cargo units are commercially available through at least one company, Seaco.

Though the above conventional cargo units are used for many kinds of shipping, they do not meet all of the U.S. Army's logistic needs. A cargo unit is needed which allows quick, convenient loading and unloading of vehicles but keeps the advantages of the conventional units. I have designed such a cargo unit. It has an end wall that swings outward to act as a ramp for a vehicle to roll onto or off the unit. The ramp also swings to an upright, fixed position both to protect the vehicles and permit stacking of the units during shipment. After unloading the vehicles, the ramp folds inward relative to the unit so that ramp lies on a lower frame of the unit. The unit is thus collapsed and can be stacked with other ISO shipping containers. During the folded in or swung out positions of the ramp, an ISO shipping corner is exposed, and this corner is used as a connection point. The exposed shipping corner of one unit is fixed to a like corner on the underside of another unit, typically by a twist lock connector.

The ramp's mobility between an inwardly folded position, a fixed upright position and a swung-out position is due to a unique hinge connection between the lower frame and the ramp. The hinge connection includes a terminus on the lower frame. The terminus has opposed upright walls, each of which defines a slot whose major diameter is normal to the lower frame. The terminus engages a floating block which has pins rotatably and slidably fit in the terminus's slots. The hinge connection also includes an ear on the ramp, the ear facing against the floating block. The ear defines a slot aligned with the longitudinal axis of the post, and a stud on the floating block engages this slot. The stud and slot allow the post to rotate and slide relative to the floating block.

DETAILED DESCRIPTION

Figure 1:
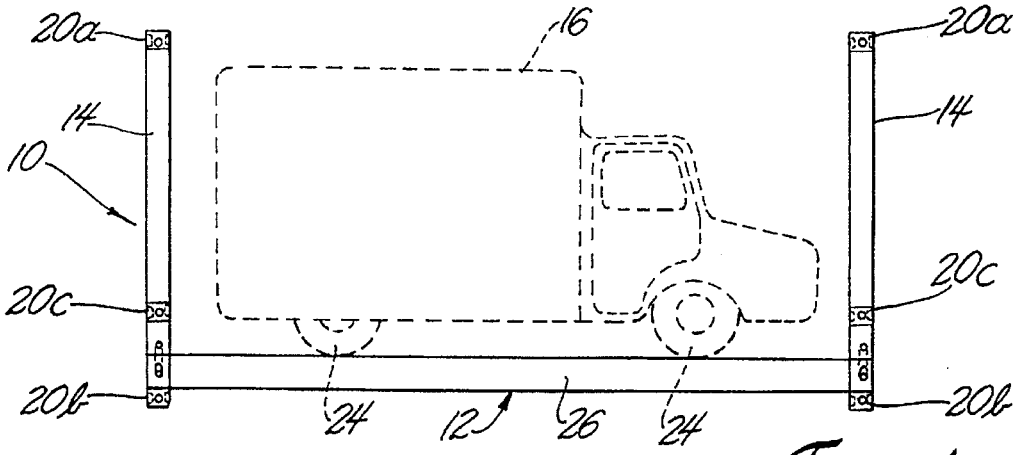
FIG. 1 is a side view of the cargo unit with the ramps in the fixed upright position. A vehicle is shown in the cargo unit with dashed lines.

FIG. 1 shows a modular cargo unit 10 having a base or lower frame portion 12 and having four corner posts 14 attached to the lower frame portion. A vehicle 16 to be shipped rests on lower frame portion 12 and vehicle 16 is tied down by any known mechanism, which is not shown. The surface of lower frame 12 upon which vehicle 16 rests is approximately 12 to 18 inches off the ground. Cargo unit 10 can be much longer than shown in FIG. 1, so that the cargo unit can accommodate several vehicles 16 lined end to end on the unit.

Figure 14:
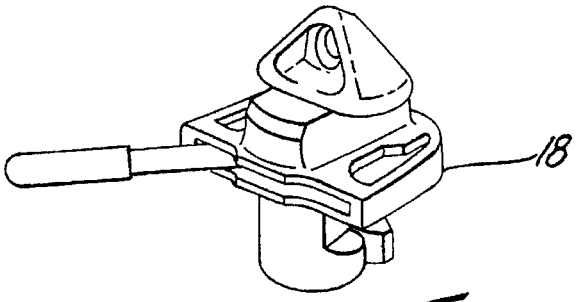
FIG. 14 is a perspective view of a conventional connector or fastener by which a shipping corner on one cargo unit is secured to a shipping corner of another cargo unit.

Cargo unit 10 is provided with standard ISO shipping corners by which cargo unit 10 engages other shipping containers when stacked together with them. In the cargo carrying (FIG. 1) configuration of the cargo units, an upper shipping corner 20*a* of one cargo unit is fixed to the lower shipping corner 20*b* of another cargo unit by conventional connectors or fasteners. One such fastener, a manual twist lock 18, is shown in FIG. 14. In the collapsed (FIG. 3) configuration of the cargo units, an exposable shipping corner 20*c* of one cargo unit is fixed to the lowest shipping corner 20*b* of another unit. In accordance with ISO standards, the shipping corners extend ¼" laterally and longitudinally from cargo unit 10.

Figure 3:
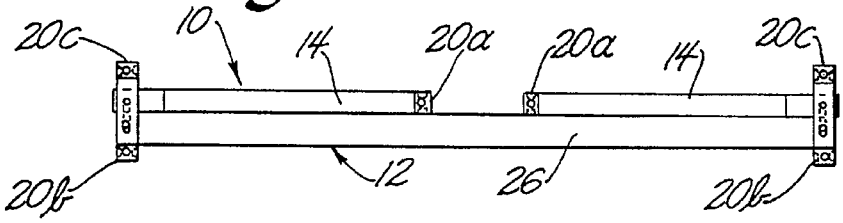
FIG. 3 is a side view of a collapsed cargo unit.
Figure 4:
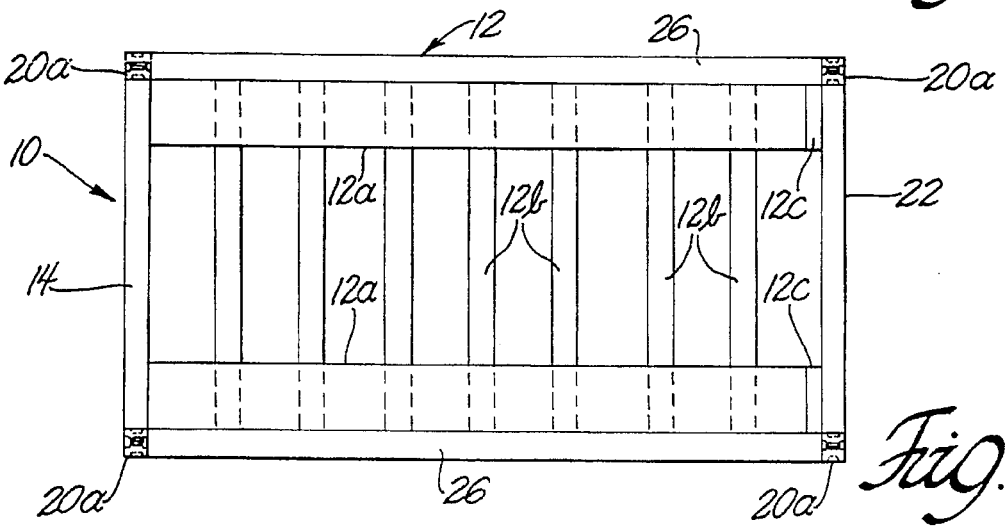
FIG. 4 is a plan view of the cargo unit with the ramps in the fixed upright position.

Several lateral cross members 22 are fixed between the posts 14 at the ends of unit 10, as seen in FIG. 4. Cross members 22 and posts 14 together comprise a ramp that can fold outward from the cargo unit as shown in FIG. 3. The posts form the lateral sides of the ramp and the cross members are sufficiently close together so that the ramp bears vehicle 16 as it rolls onto or of cargo unit 10. Alternatively, the ramp can simply be a reinforced panel fixed between the posts or optional treadways 12*c* (FIG. 4) can be fixed to the ramp.

As further seen in FIG. 4, the cargo unit's lower frame portion 12 typically includes longitudinal floor panels 12*a* which wheels 24 of vehicle 16 rest. Typical floor beams 12*b* underlie and support panels 12*a* and are connected between lateral beams 26. Treadways 12*c*, which are similar to floor panels 12*a*, may be fixed to cross members 22 of the ramp, and wheels 24 would roll on panels 12*c* as vehicle 16 goes onto or off unit 10.

As seen in FIG. 3, the ramps can be folded inward relative to cargo unit 10 so that the ramps lie on lower frame portion The cargo unit thus reconfigures to a compact, collapsed condition. A set of collapsed units 10 can be stacked and connected together via the shipping corners and connectors 18.

Figure 2:
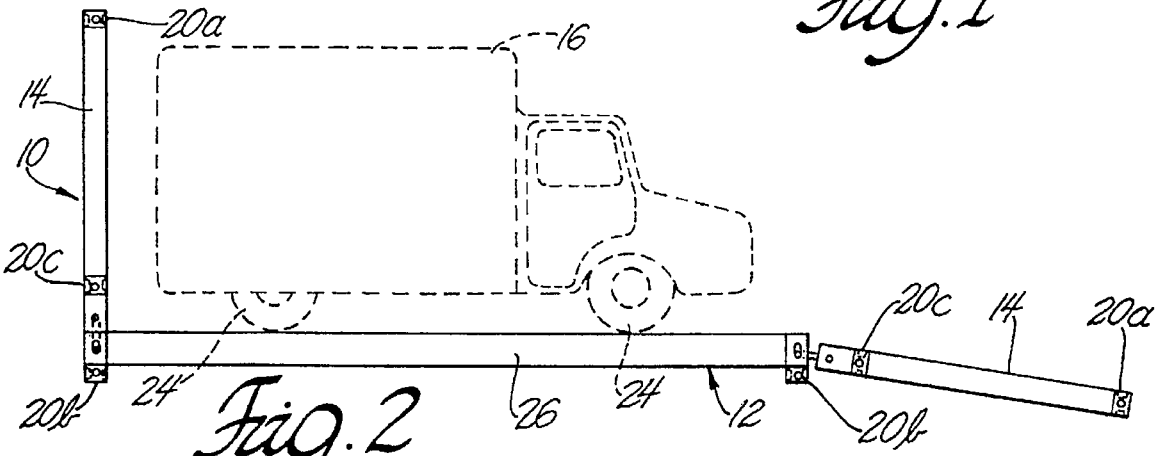
FIG. 2 is a side view of the cargo unit with one ramp in a fully swung down position. A vehicle is shown in the cargo unit with dashed lines.
Figure 5:
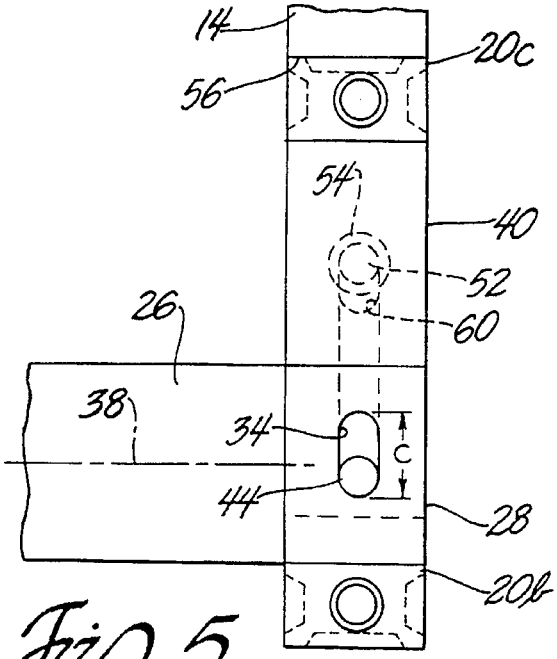
FIG. 5 is a side view of the hinge connection between the ramp and lower frame of the cargo unit when the ramp is in a fixed upright position.
Figure 6:
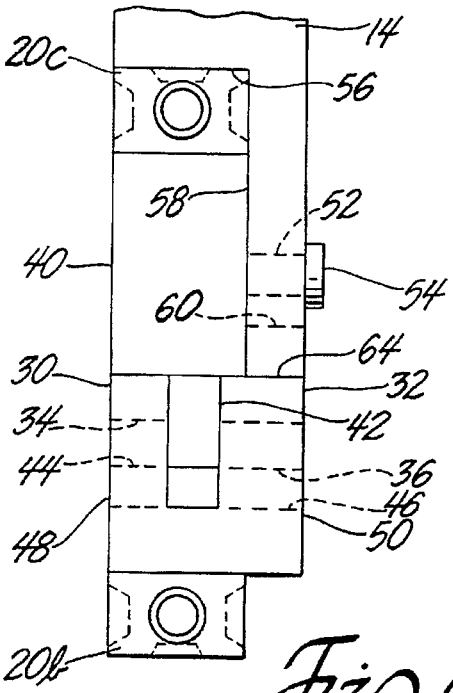
FIG. 6 is an end view of the hinge connection between the ramp and lower frame of the cargo unit when the ramp is in the fixed upright position.

The outward and inward folding of the ramps, seen in FIGS. 2 and 3 respectively, is possible due to a unique hinge connectors between posts 14 and lateral beams 26. FIGS. 5 through 13 show details of the connection. In FIGS. 5 and 6, lateral beam 26 has a terminus 28 welded thereto or integral therewith, terminus 28 having a lower shipping corner **20*b* affixed thereto. Terminus 28 is a generally channel shaped block having a thinner upright wall 30 and a thicker, opposed upright wall 32. The tops of the upright walls are flush with the top of lateral beam 26. Upright walls 30 and 32 respectively define apertures 34 and 36, these apertures being elongate and oval in cross section. These apertures are also cross-sectionally identical, and are aligned or in registry with one another. The major diameters of the apertures are shown as "C" in FIG. 5. These diameters are vertical and thus normal to the longitudinal axis 38 of lateral beam 26 and are normal to the general plane defined by lower frame 12**.

Figure 7:
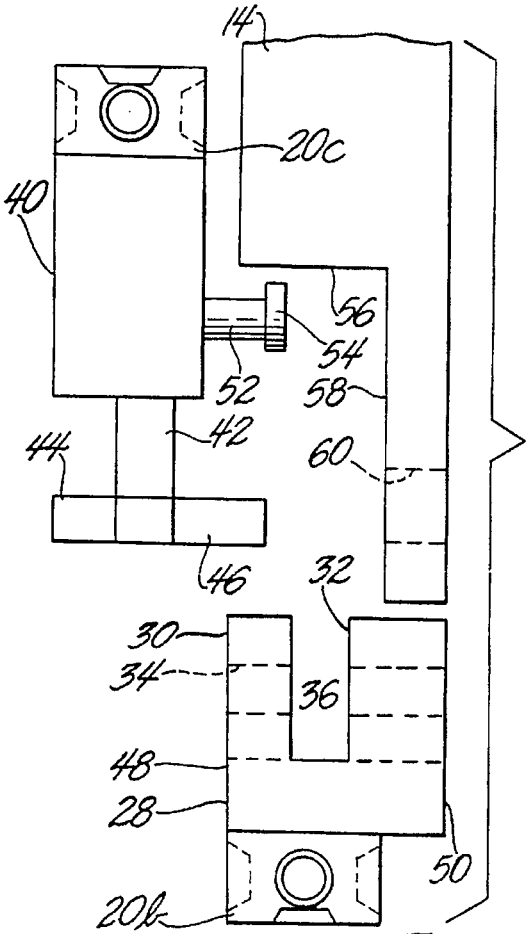
FIG. 7 is an exploded view showing separately the ear, floating block and terminus that are elements of the hinge connection.
Figure 8:
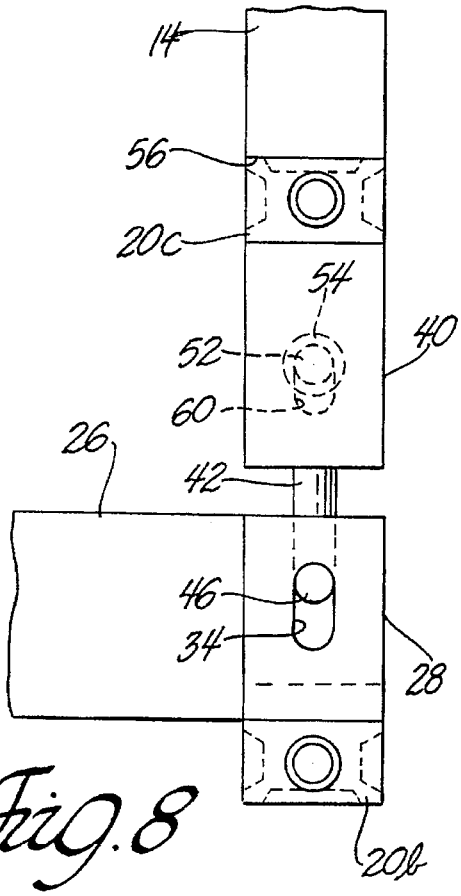
FIGS. 8 through 11 are side views of the hinge connection as the ramp moves from the fixed upright position to a swung out position.
Figure 9:
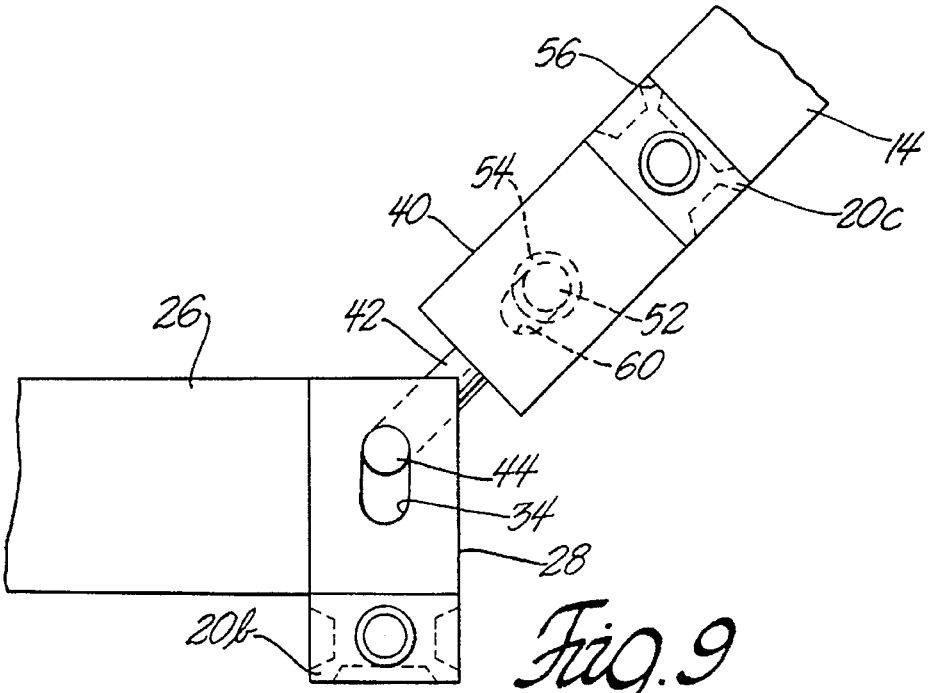
Figure 10:
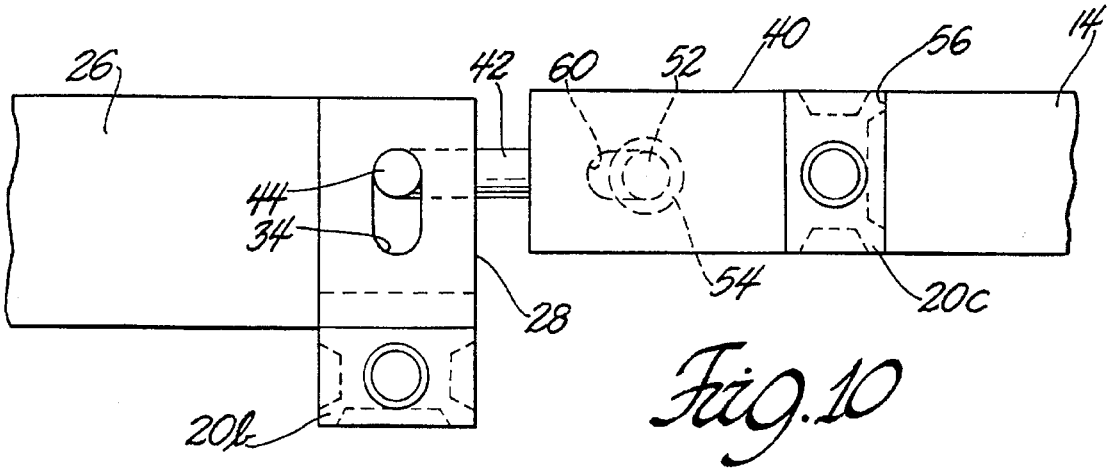

Engaged to terminus 28 is a floating block 40, which perhaps can most clearly be seen in FIG. 7. An exposable shipping corner **20*c* is fixed to one end of the floating block. Finger 42 protrudes from the end of the floating block opposite the shipping corner. Extending from the finger are a shorter round pin 44 and a longer round pin 46 that closely engage respective apertures 34 and 36. The pins are rotatable and slidable in these apertures. As seen in FIG. 6, the free ends of the pins are flush with the outer surfaces 48 and 50 of upright walls 30 and 32. Projecting perpendicularly from one side of block 40 is a cross-sectionally round lateral stud 52 having a head 54, stud 52 being parallel to pins 44 and 46**.

The lower end of post 14 defines a shoulder 56 adjacent a generally rectangular plate-like ear 58 normal to the shoulder. The shoulder and ear form a corner that can fit conformingly onto floating block 40, as best seen in FIG. 6. Ear 58 is disposed at the side of floating block 40 that faces normally inward or inboard relative to cargo unit 10. In FIGS. 5 and 6, ear 58 facially contacts terminus 28 at interface 64, so that vertical loads from post 14 transfer through ear 56 to terminus 28. There also is facial contact between the exposable shipping corner **20*c* and shoulder 56, and there is facial contact between floating block 40 and terminus 28. Through these latter facial contacts, vertical loads transfer from post 14 through floating block 40 to terminus 28**.

Figure 11:
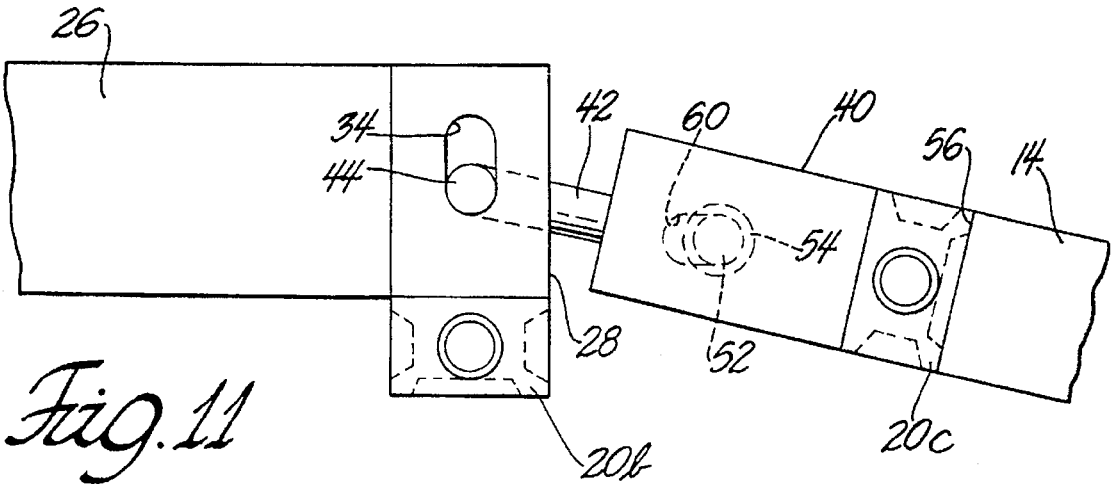
Figure 12:
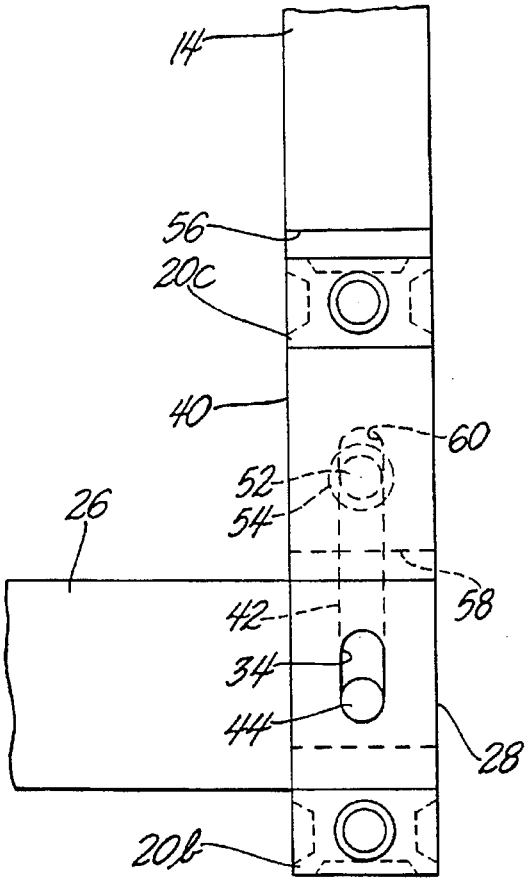
FIGS. 12 and 13 are side views of the hinge connection of the ramp moves from the fixed upright position to an inwardly folded position where the ramp lies on the lower frame of the cargo unit.

Ear 58 has a cross-sectionally oval slot 60 whose width is equal to the diameter of stud 52 so that stud 52 fits closely in slot 60. The depth of slot 60 is equal to the length of stud 52 so that ear 58 fits closely between head 54 and floating block 40. The engagement between stud 52 and slot 60 causes post 14 to be both rotatably and slidably connected to floating block As noted before, post 14 can be moved from its upright position (FIGS. 1 and 5) to a lowered, swung out, position (FIGS. 2 and 11). This is done by first moving post 14 and floating block 40 together to their raised, FIG. 8 position. When the post and floating block are so moved, apertures 34 and 36 accommodate the upward motion of pins 44 and 46. Then the post and floating block are swung down together about the axes of these pins through the FIG. 9 position, through the FIG. 10 position and finally to the FIG. 11 position. In the FIG. 2 and FIG. 11 configurations, neither floating block 40 nor any part of the hinge connection between post 14 and beam 26 is higher than the top of beam 26. Consequently the hinge connection is not an obstacle for vehicle 16 to roll on or off the ramp formed by posts 14 and cross members 22 (FIG. 4).

Figure 13:
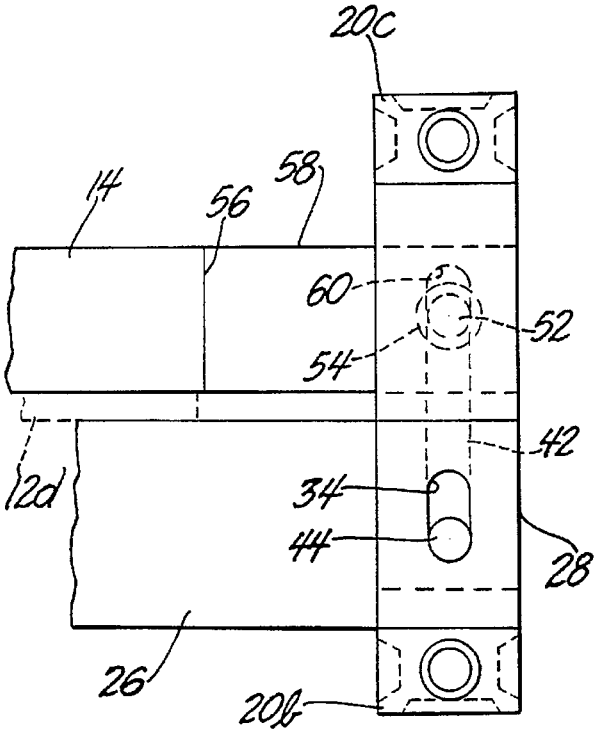

Post 14 can also be moved from its upright position to a folded, swung in, position (FIGS. 3 and 13). This is done by moving post 14 up and away from floating block 40, to the FIG. 4 position. The post is then swung in down and in to the FIG. 13 position. In that position, ear 58 does not extend outward of unit 10 (to the right in FIG. 13) beyond floating block 40. As a result, ear 56 does not increase the length dimension of cargo unit 10 during the folded in position of post 14.

FIG. 13 shows an optional, and in at least some cases, preferred, panel **12*d* atop beam 26. Panel 12*d* is typically a horizontal treadway or floor panel upon which post 14 may rest during the cargo unit's collapsed configuration. If panel 12*d* is not present, post 14 is simply lowered onto beam 26**.

I wish it understood that I do not desire to be limited to the exact details of construction or method shown herein since obvious modifications will occur to those skilled in the relevant arts without departing from the spirit and scope of the following claims.

What is claimed is:

1. A stackable, collapsible cargo unit for carrying one or more vehicles, the cargo unit comprising:

a ramp by which the vehicle rolls on or off the unit, the ramp being swingable to an upright fixed position and foldable inwardly relative to the unit, the ramp having at least one post;

a lower frame;

one or more elongate members on the frame capable of bearing the vehicle;

a terminus fixed to the lower frame;

a floating block rotatably and slidably connected to the terminus; and an ear at one end of the post, the ear rotatably and slidably connected to the floating block.

2. A cargo unit for carrying one or more vehicles, the cargo unit comprising:

a ramp by which the vehicle rolls on or off the unit, the ramp being swingable to an upright fixed position and foldable inwardly relative to the unit;

a lower frame;

one or more elongate members on the frame capable of bearing the vehicle;

a hinge connection between the ramp and the lower frame comprising a terminus fixed to the lower frame, the terminus being a generally channel shaped block having opposed upright walls defining opposed cross-sectionally elongate apertures, the elongate apertures having major diameters perpendicular to a general plane of the lower frame, a floating block, a finger of the floating block, the finger having pins rotatably and slidably engaging the elongate apertures of the terminus;

a post at a lateral side of the ramp, an ear at a shoulder on an end of the post, the ear defining an elongate slot parallel with the longitudinal axis of the post, the ear facing the floating block, a stud on the floating block engaging the elongate slot whereby the post is rotatably and slidably connected to the floating block.

3. The cargo unit of claim 2 wherein the floating block further comprises:

a flat face with the finger extending therefrom;

a shipping corner fixed to the floating block at an opposite side of the floating block from the flat face.

4. The cargo unit of claim 3 wherein the ear, floating bloc and terminus have a first position in which:

the post is upright;

the shoulder lies upon the shipping corner;

the ear facially contacts the floating block;

the floating block rests on the terminus in facial contact therewith;

whereby vertical loads on the post are transferred to the terminus both through the ear and through the floating block.

5. The cargo unit of claim 4 wherein the shipping corner is a first shipping corner and the cargo unit further comprises a second shipping corner, the second shipping corner being fastened to the bottom of the terminus.

6. The cargo unit of claim 4 wherein:

the ear, floating block and terminus have other positions where the shoulder is swung clear of the shipping corner, whereby a top of the shipping corner is exposed.

7. A stackable, collapsible cargo module for carrying one or more vehicles, the cargo unit comprising:

a lower frame a ramp by which the vehicle rolls on or off the unit, the ramp beings wing able to an upright fixed position and foldable inwardly relative to the unit to lie upon the lower frame;

one or more elongate members of the frame capable of bearing the vehicle;

a hinge connection between the ramp and the lower frame comprising a terminus fixed to the lower frame, the terminus being a generally channel shaped block having opposed upright walls defining opposed cross-sectionally elongate apertures, the elongate apertures being aligned with one another and having major diameters perpendicular to a general plane of the lower frame, a floating block, the floating block having a finger with pins rotatably and slidably fitting with the elongate apertures of the terminus;

a post at a lateral side of the ramp, a shoulder on one end of the post, a plate-like ear at one edge of the shoulder, the ear defining an elongate slot parallel with the longitudinal axis of the post, the ear adjacently facing the floating block, the floating block also including: a stud that engages the elongate slot whereby the post is rotatably and slidably connected to the floating block;

means for holding the ear on the stud in adjacent facing relation to the floating block.

8. The cargo unit of claim 7 further comprising a shipping corner on one end of the floating block, the one end being opposite the end of the floating block having the finger.

9. The cargo unit of claim 7 wherein the tops of the upright walls are flush with the top of the elongate member.

10. The cargo unit of claim 9 wherein:

the hinge connection comprises a single ear; and the ear is disposed at a side of the floating block facing inboard relative to the cargo unit.

* * * * *